United States Patent [19]

Yoshioka et al.

[11] 4,000,223

[45] Dec. 28, 1976

[54] ACCELERATION PUMP APPARATUS IN A CARBURETOR

[75] Inventors: Yuichi Yoshioka, Asaka; Tsugio Sanka, Wako, both of Japan

[73] Assignees: Honda Giken Kogyo Kabushiki Kaisha, Tokyo; Kabushiki Kaisha Keihin Seiki Seisakusho, Kawasaki, both of Japan

[22] Filed: Feb. 18, 1976

[21] Appl. No.: 658,996

[30] Foreign Application Priority Data

Feb. 20, 1975 Japan ..... 50-22510

[52] U.S. Cl. ..... 261/34 A; 74/100 R

[51] Int. Cl.[2] ..... F02M 7/08

[58] Field of Search ..... 261/34 A; 74/100 R, 74/99 R, 97, 599

[56] References Cited

UNITED STATES PATENTS

| | | | |
|---|---|---|---|
| 686,194 | 11/1901 | Ball | 74/100 |
| 1,617,666 | 2/1927 | Cattaneo | 74/599 |
| 1,846,263 | 2/1932 | Kull et al. | 74/599 |
| 1,933,395 | 10/1933 | Skoogh | 261/34 A |
| 2,345,168 | 3/1944 | Wirth et al. | 261/34 A |
| 2,451,449 | 10/1948 | Sacchini | 74/100 |
| 2,785,880 | 3/1957 | Olson | 261/34 A |
| 3,204,935 | 9/1965 | McSeveny | 261/34 A |
| 3,328,010 | 6/1967 | Urich et al. | 261/34 A |
| 3,961,544 | 6/1976 | Phillips | 74/99 R |

FOREIGN PATENTS OR APPLICATIONS

| | | | |
|---|---|---|---|
| 2,138,023 | 4/1973 | Germany | 261/34 A |
| 610,046 | 10/1948 | United Kingdom | 261/34 A |

*Primary Examiner*—Tim R. Miles
*Attorney, Agent, or Firm*—Haseltine, Lake & Waters

[57] ABSTRACT

An acceleration pump apparatus in a carburetor having a pivotable throttle valve operation drum and an acceleration pump, a driving lever for the acceleration pump being pivotally mounted on a supporting shaft which is parallel to the support shaft of the throttle valve operation drum so as to be turnable in the same direction as the throttle valve operation drum. One end of the driving lever is in engagement with a push rod for operating the acceleration pump, and the other end of the lever has a surface facing a pin secured on the throttle valve operation drum, the pin and driving lever being held in engagement with one another by a tension spring.

6 Claims, 2 Drawing Figures

ACCELERATION PUMP APPARATUS IN A CARBURETOR

DETAILED EXPLANATION OF INVENTION

This invention relates to an acceleration pump apparatus in a carburetor and it has for its object to provide such an apparatus wherein the acceleration fuel injection characteristic can be easily adjusted.

Figure 1:
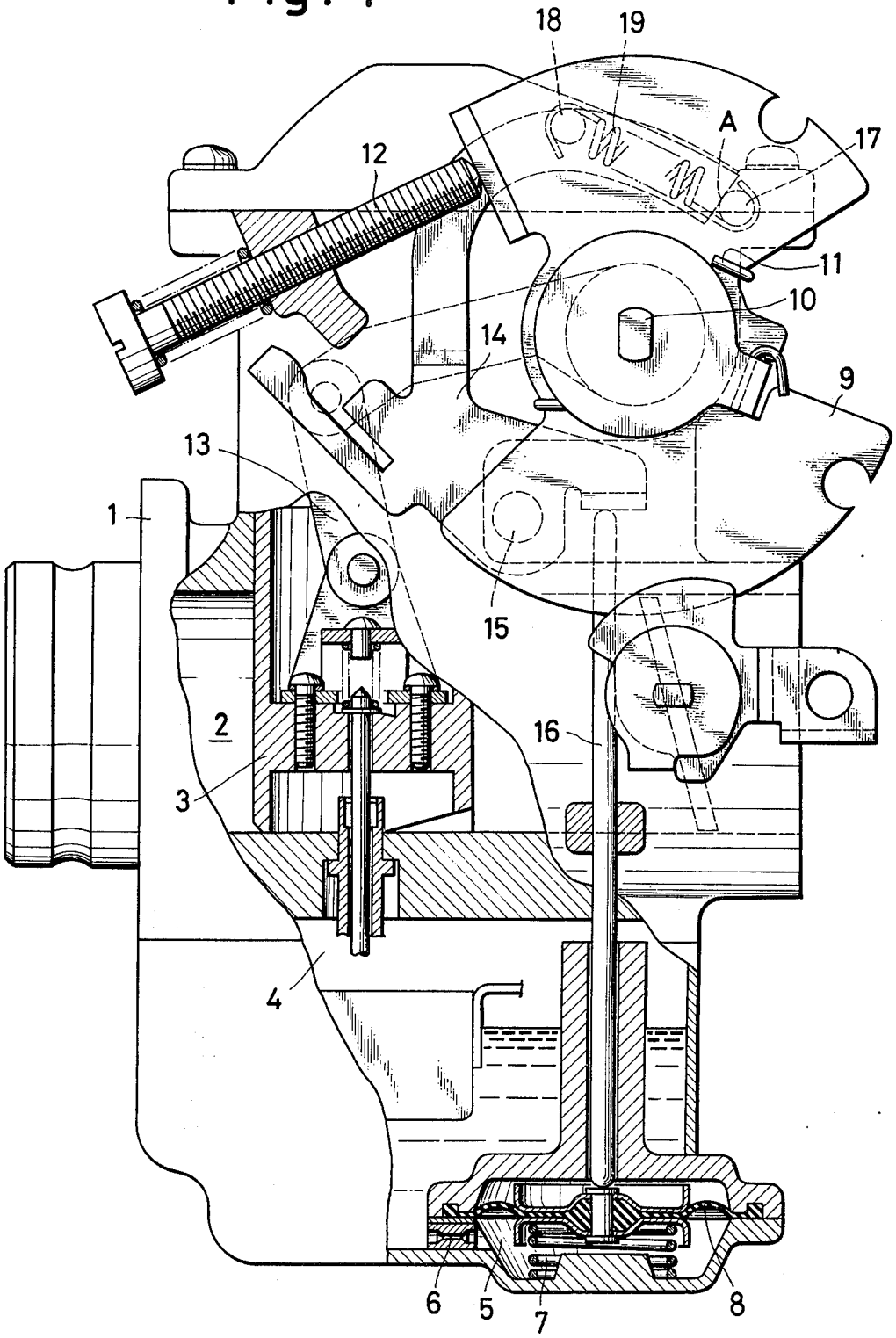
Figure 2:
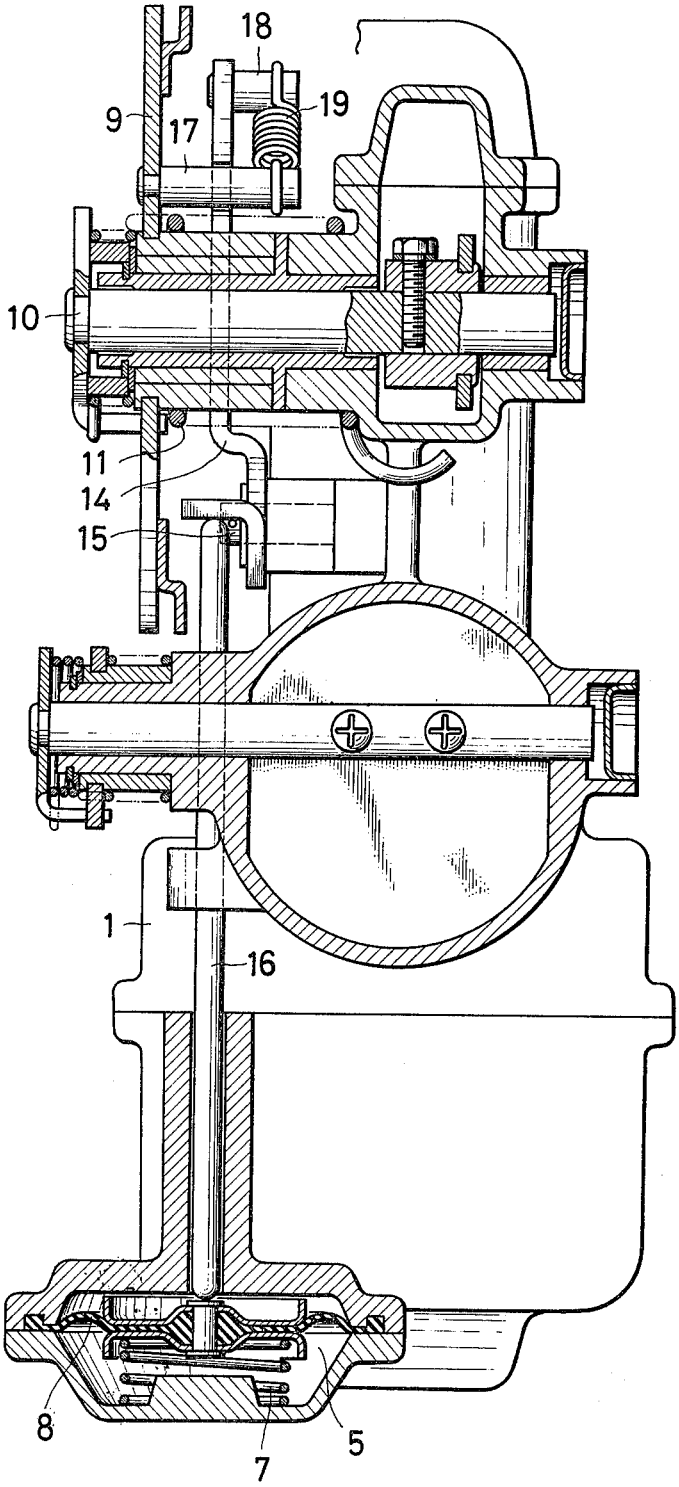

One embodying example of this invention will now be explained in detail with reference to the accompanying drawing wherein: FIG. 1 is a front view, partly in section, of a portion of one embodiment according to the invention, and FIG. 2 is a sectional side view of the same.

Referring to the drawing, numeral 1 denotes a carburetor body, numeral 2 denotes an intake passage, numeral 3 denotes a slidable throttle valve, numeral 4 denotes a float chamber which maintains a predetermined fuel-level, and numeral 5 denotes an acceleration fuel pump comprising a pump chamber which is in communication through a jet passage 6 to the float chamber 4. A compression spring 7 is contained therein and a wall thereof is partly formed of a flexible diaphragm 8, and the outer surface of the diaphragm 8 is acted on by the atmosphere. Numeral 9 denotes a throttle valve operation drum, and this drum 9 is secured to a supporting shaft 10 and is subjected to a closing directional load by a throttle valve return spring 11, and the minimum open degree of the throttle valve 3 is regulated by a stop screw 12, and opening and closing turning operations of the throttle valve operation drum 9 may be carried out through a throttle wire (not illustrated) or the like. Numeral 13 denotes link mechanism for transmitting a turning force of the throttle valve operation drum 9, that is, a turning force of the supporting shaft 10 to the slidable throttle valve 3.

Numeral 14 denotes a bell-crank type driving lever for driving acceleration pump 5, and the lever 14 is pivotally supported by a supporting shaft 15 which is parallel to supporting shaft 10, so as to be turnable in the same direction as the foregoing drum 9, and one end of lever 14 is in engagement with a push rod 16 for moving the acceleration pump 5, and the other end thereof is arranged to face a pin 17 provided on the throttle valve operation drum 9, and further a tension spring 19 is connected between the pin 17 and a pin 18 on the driving lever 14, so that in the ordinary case the end surface of the driving lever 14 and the pin 17 are in contact engagement with one another.

It is preferable in this case that the position of the foregoing pin 17, that is, a contact point A between the end surface of the driving lever 14 and the pin 17 is designed to be on or near an extension of a line connecting the axis of the supporting shaft 15 and that of the supporting shaft 10, at the time when the throttle valve 3 is in the minimum open degree of idling. With this arrangement, in the case where the throttle valve 3 is opened within its small open degree, the turning direction of the end surface of the driving lever 14 and that of the pin 17 provided on the drum 9 are nearly in the same circumferential direction, so that a mechanical friction loss at the initial period of acceleration, which is serious in this kind of acceleration pump driving mechanism, can be descreased without using a roller bearing or the like.

The operation of the embodying example of this invention having the above construction will now be explained as follows:

If the throttle valve operation drum 9 is rapidly turned in the clockwise direction by means of a throttle wire (not illustrated) or the like, the slidable throttle valve 3 is lifted through the link mechanism 13 to open the intake passage 2 and at the same time, this opening operation is transmitted to the driving lever 14 through the pin 17, the tension spring 19 and the pin 18, and thus the flexible diaphragm 8 of the acceleration pump 5 is pushed thereby through the push rod 16 and acceleration fuel is supplied to the intake passage 2 through a delivery passage and a delivery opening (not illustrated) and engine acceleration is obtained.

The injection timing, the injection quantity per unit time and other factors are determined in accordance with the required characteristics of a given engine, and there are various means for adjusting to the required characteristics. According to this invention, however, this is effected by load setting of the compression spring 7 and the tension spring 19. Namely, if the throttle valve operation drum 9 is rapidly turned for opening, the pin 17 is forced to move rapidly and the contact engagement relation between the pin 17 and the end surface of the driving lever 14 is temporarily released and the deflection amount of the tension spring 19 is increased with the movement of the pin 17 and the spring load of the tension spring 19 is increased and accumulated.

Consequently, only at the moment that a value above a set load of the compression spring 7 has been accumulated in the tension spring 19, will the driving lever 14 begin to turn for driving the acceleration pump 5. Thus, the required characteristics of the engine can be met by such a means that the initial setting loads, spring constants and others of the tension spring 19 and the compression spring 7 are properly selected.

Thus, according to this invention, it is advantageous that the injection timing, the injection quantity per unit time and other characteristics of the pump can be adjusted at will, to meet the desired characteristics of the engine by selecting the initial loads, spring constants and others of the springs, and the tension spring can be simply attached and detached for replacement from the exterior. Additionally in the case where the position of the pin 17 is designed to be such as above, the friction loss caused in the acceleration pump driving mechanism at the time of the opening operation of the throttle valve in a small open degree within which the throttle valve return force is comparatively small and a reliable responsibility thereof is required, can be decreased without providing a roller bearing or the like.

What is claimed is:

1. Acceleration pump apparatus in a carburetor comprising a throttle valve operating drum, a support shaft defining an axis of rotation for said drum, an acceleration pump unit, a driving lever for said acceleration pump unit, a second shaft connected to said drum and extending parallel to said support shaft, said driving lever being pivotably connected to said second shaft and turnable with said drum, a push rod operatively engaged with said acceleration pump unit and with said lever to transmit operating force from said lever to said acceleration pump unit upon rotation of said drum, said lever having an end spaced from said second shaft, a pin secured to said drum and facing said end of said lever, and spring means connecting said pin and lever to urge said end of the lever and pin into abutment with one another.

2. Apparatus as claimed in claim 1 wherein said spring means comprises a tension spring.

3. Apparatus as claimed in claim 2 wherein said drum has an initial position corresponding to a small open position of a throttle valve, said end of the lever lying on a line passing substantially through said shafts.

4. Apparatus as claimed in claim 3 wherein said lever includes a curved portion at the extremity of which is said end.

5. Apparatus as claimed in claim 1 wherein said acceleration pump unit includes a diaphragm and a biassing spring.

6. Apparatus as claimed in claim 5 wherein said biassing spring is a compression spring.

* * * * *